US008267273B2

(12) United States Patent
Volzke et al.

(10) Patent No.: US 8,267,273 B2
(45) **Date of Patent: *Sep. 18, 2012**

(54) HOLE PLUG SYSTEM HAVING OPPOSED ENGAGING ENDS

(76) Inventors: Lauren D. Volzke, Aberdeen, SD (US); Dennis M. Volzke, Aberdeen, SD (US)

( * ) Notice: Subject to any disclaimer, the term of this patent is extended or adjusted under 35 U.S.C. 154(b) by 813 days.

This patent is subject to a terminal disclaimer.

(21) Appl. No.: 11/839,203

(22) Filed: Aug. 15, 2007

(65) Prior Publication Data

US 2009/0045197 A1 Feb. 19, 2009

(51) Int. Cl.

| | |
|---|---|
| ***B65D 53/00*** | (2006.01) |
| ***B65D 51/00*** | (2006.01) |
| ***B65D 43/04*** | (2006.01) |
| *B65D 39/00* | (2006.01) |

(52) U.S. Cl. ..... 220/212; 220/239; 220/287; 220/801; 220/DIG. 19; 220/796; 215/355

(58) Field of Classification Search ..... 220/212, 220/801, 796, DIG. 19, 239; 215/355; 138/89; 446/125; 401/95; 217/110, 113, 98
See application file for complete search history.

(56) References Cited

U.S. PATENT DOCUMENTS

| | | | | |
|---|---|---|---|---|
| 3,987,930 | A * | 10/1976 | Fuson | 220/287 |
| 4,645,096 | A * | 2/1987 | Grant | 222/153.09 |
| 6,033,170 | A * | 3/2000 | Gold | 411/480 |
| D455,652 | S * | 4/2002 | Wyslotsky et al. | D9/429 |
| 7,476,228 | B2 * | 1/2009 | Abdou | 606/104 |
| 2008/0011375 | A1 * | 1/2008 | Soubjaki | 138/89 |

OTHER PUBLICATIONS

CAPLUGS, Plugs website available at <http://www.caplugs.com/catalog/NavMenu.asp?classid=200>.

* cited by examiner

*Primary Examiner* — Robin Hylton
(74) *Attorney, Agent, or Firm* — Neustel Law Office

(57) ABSTRACT

A conical hole plug for efficiently sealing various size and configuration holes and openings. The conical hole plug generally includes a first elongated portion including a first inner end and a first outer end, wherein the first inner end is opposite the first outer end and wherein the first elongated portion includes a first tapered outer surface extending inwardly toward the first outer end. A second elongated portion extends from the first elongated portion, wherein the second elongated portion includes a second inner end and a second outer end, wherein the second inner end is opposite the second outer end and wherein the second inner end extends from the first inner end and wherein the second elongated portion includes a second tapered outer surface extending inwardly toward the second outer end.

14 Claims, 7 Drawing Sheets

HOLE PLUG SYSTEM HAVING OPPOSED ENGAGING ENDS

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to plugs and more specifically it relates to a conical hole plug for efficiently sealing various size and configuration holes and openings.

2. Description of the Related Art

Any discussion of the prior art throughout the specification should in no way be considered as an admission that such prior art is widely known or forms part of common general knowledge in the field.

Plugs have been in use for years. Typically, plugs are utilized to seal a particular size hole or opening, wherein the plug is generally inserted within the hole or surrounds an outer perimeter of the hole. Plugs are generally manufactured in various sizes to accommodate a respective hole or opening. Plugs are also generally manufactured in various configurations (e.g. threaded, uniform thickness, tapered thickness, smooth, etc.) to accommodate the respective hole that is desired to be sealed.

It can be difficult for a user to find the correct size and configuration plug to efficiently seal a particular hole, wherein plugs are generally manufactured to accommodate only one hole size/configuration or else a very narrow range of hole sizes/configurations. It can also be expensive for the user to buy a specific size/configuration plug for each size/configuration hole that is desired to be sealed. Because of the general lack of efficiency and practicality in the prior art there is the need for a new and improved conical hole plug for efficiently sealing various size and configuration holes and openings.

BRIEF SUMMARY OF THE INVENTION

The general purpose of the present invention is to provide a conical hole plug that has many of the advantages of the plugs mentioned heretofore. The invention generally relates to a plug which includes a first elongated portion including a first inner end and a first outer end, wherein the first inner end is opposite the first outer end and wherein the first elongated portion includes a first tapered outer surface extending inwardly toward the first outer end. A second elongated portion extends from the first elongated portion, wherein the second elongated portion includes a second inner end and a second outer end, wherein the second inner end is opposite the second outer end, wherein the second inner end extends from the first inner end and wherein the second elongated portion includes a second tapered outer surface extending inwardly toward the second outer end.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a conical hole plug for efficiently sealing various size and configuration holes and openings.

Another object is to provide a conical hole plug that does not require any adjusting.

Another object is to provide a conical hole plug that does not include any moving parts.

Another object is to provide a conical hole plug that may be utilized in a wide variety of industries, equipment and machinery (e.g. sandblasting, painting, maintenance, air conditioning, automobile mechanics, plumbing, etc.).

An additional object is to provide a conical hole plug that is easy to utilize.

A further object is to provide a conical hole plug that prevents fluids from leaking through or around an outer perimeter of the plug.

Another object is to provide a conical hole plug that may be easily inserted/removed from the hole/opening.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
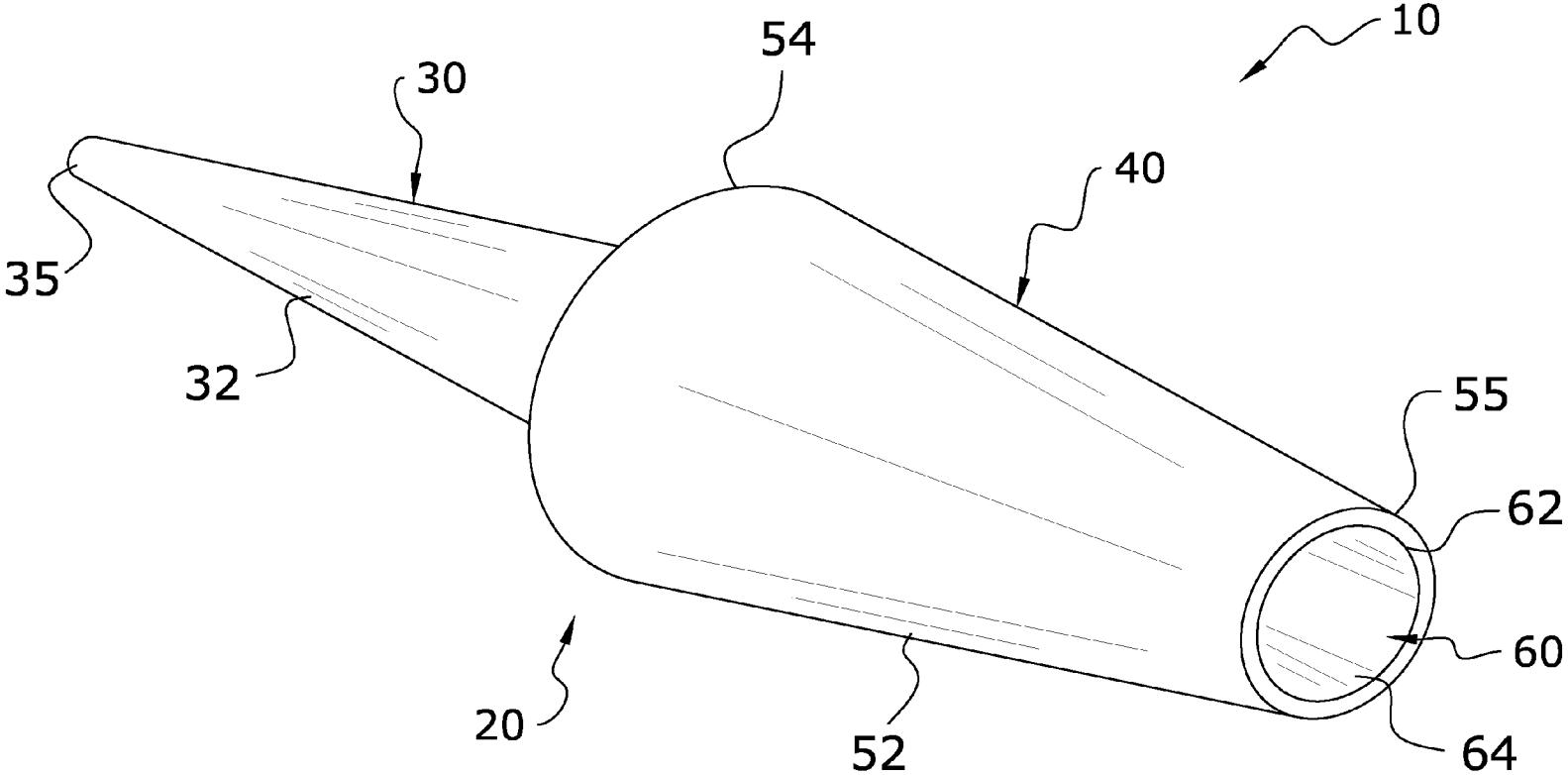
FIG. 1 is an upper perspective view of the present invention from a first direction.
Figure 2:
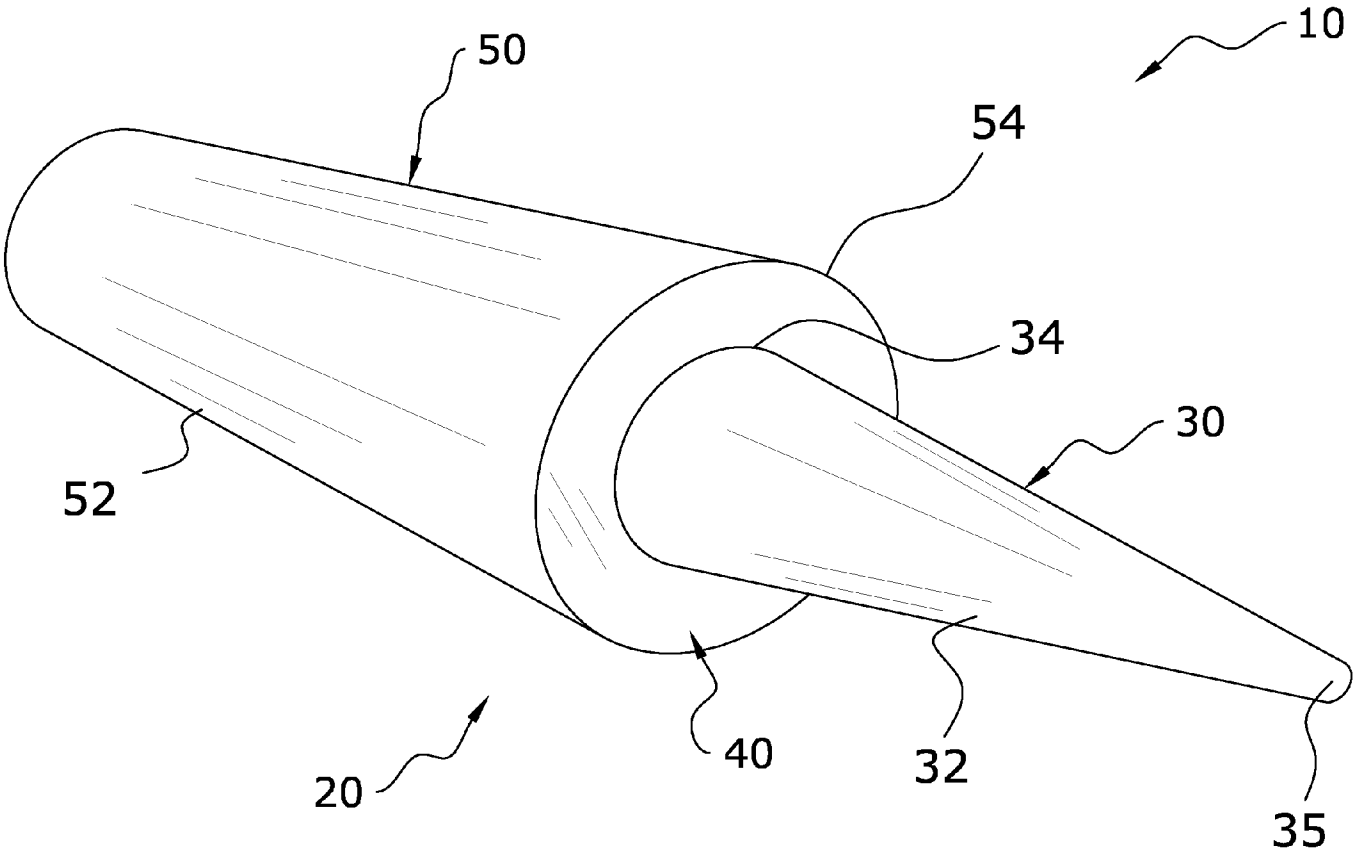
FIG. 2 is an upper perspective view of the present invention from a second direction.

Turning now descriptively to the drawings, in which similar reference characters denote similar elements throughout the several views, FIGS. 1 through 7 illustrate a conical hole plug 10, which comprises a first elongated portion 30 including a first inner end 34 and a first outer end 35, wherein the first inner end 34 is opposite the first outer end 35 and wherein the first elongated portion 30 includes a first tapered outer surface 32 extending inwardly toward the first outer end 35. A second elongated portion 50 extends from the first elongated portion 30, wherein the second elongated portion 50 includes a second inner end 54 and a second outer ends 55, wherein the second inner end 54 is opposite the second outer end 55 and wherein the second inner end 54 extends from the first inner end 34 and wherein the second elongated portion 50 includes a second tapered outer surface 52 extending inwardly toward the second outer end 55.

B. Auxiliary Structure

The auxiliary structure 12 may be comprised of various types all which include a hole 14 or passageway extending through or partially through. Examples of auxiliary structures 12 include a wall, a hose, and various components in fields such as automobile mechanics, fluid power, maintenance, air conditioners, farming, plumbing, painting, sandblasting and various others.

The hole 14 may be comprised of various configurations, such as but not limited to threaded, smooth, tapered, uniform diameter, shallow and deep. The hole 14 may further be comprised of various sizes. The present invention may be inserted within the hole 14 (e.g. hole 14 within a wall, etc.) or the auxiliary structure 12 may be inserted within the cavity 60 (e.g. end of a hose, etc.) of the present invention.

C. Plug

The plug 20 is utilized to seal holes 14 (e.g. in walls, hoses, machinery, etc.), wherein the plug 20 may be utilized to seal various size and configuration holes 14. The plug 20 is preferably comprised of a soft rubber material so as to be able to conform to the respective hole 14 that the plug 20 is inserted within. The plug 20 is also preferably comprised of a material that prevents fluid (i.e. liquid and gas) from soaking or seeping through the plug 20, wherein the plug 20 is able to efficiently fluidly seal a respective hole 14.

The rubber material also assists the user in grasping the plug 20 and maneuvering the plug 20 within the hole 14, wherein the rubber material allows the user to securely grip the plug 20. It is appreciated however that the plug 20 may be comprised of various other types of resilient and flexible materials rather than the preferred embodiment.

i. First Elongated Portion

Figure 3:
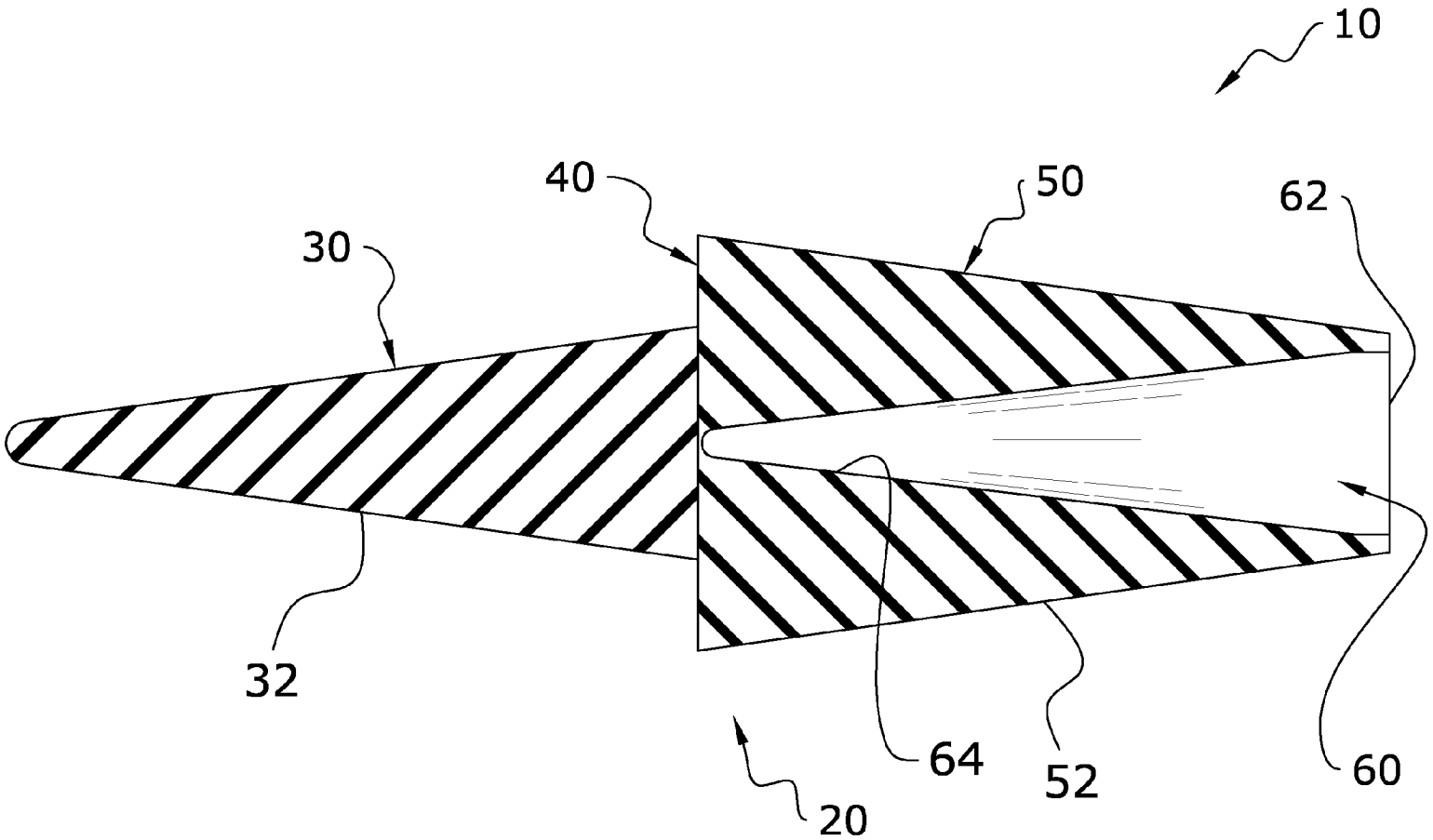
FIG. 3 is a longitudinal cross-sectional view of the present invention.

The first elongated portion 30 is comprised of a varying diameter thickness as illustrated in FIGS. 1 through 7. In the preferred embodiment of the present invention the first elongated portion 30 is comprised of a conical shaped configuration; however it is appreciated that the first elongated portion 30 may be comprised of various types of elongated shapes all of which preferably vary in thickness (e.g. triangular, etc.). The first elongated portion 30 is further preferably comprised of a solid structure as illustrated in FIG. 3.

The first elongated portion 30 includes a first inner end 34 and a first outer end 35 opposite the first inner end 34. A first inner diameter of the first inner end 34 is substantially greater than a first outer diameter of the first outer end 35, wherein the portion between the first inner end 34 and the first outer end 35 is preferably evenly tapered to connect the first inner diameter of the first inner end 34 to the first outer diameter of the first outer end 35 as illustrated in FIGS. 1 through 7.

The first outer end 35 further preferably includes a curved radii portion forming a substantial point upon the first elongated portion 30, wherein when utilizing the first elongated portion 30 to seal a hole 14 the first outer end 35 is inserted within the hole 14. The first inner end 34 is comprised of a planar configuration to efficiently be positioned against and flush with the second inner end 54 of the second elongated portion 50 at the adjoining portion 40 of the plug 20 as shown in FIGS. 2 through 7.

The first outer surface 32 of the first elongated portion 30 is comprised of a tapered configuration and connects the first outer end 35 to the first inner end 34. A first angle defined by the first outer surface 32 and a horizontal axis or concentric longitudinal axis of the present invention is preferably comprised of an acute angle. In the preferred embodiment the first angle is comprised of an approximate 16 degree angle; however it is appreciated that the first angle may be comprised of various degree angles.

ii. Second Elongated Portion

The second elongated portion 50 is comprised of a varying diameter thickness as illustrated in FIGS. 1 through 7. In the preferred embodiment of the present invention the second elongated portion 50 is comprised of a conical shaped configuration; however it is appreciated that the second elongated portion 50 may be comprised of various types of elongated shapes all of which preferably vary in thickness (e.g. triangular, etc.).

Figure 7:
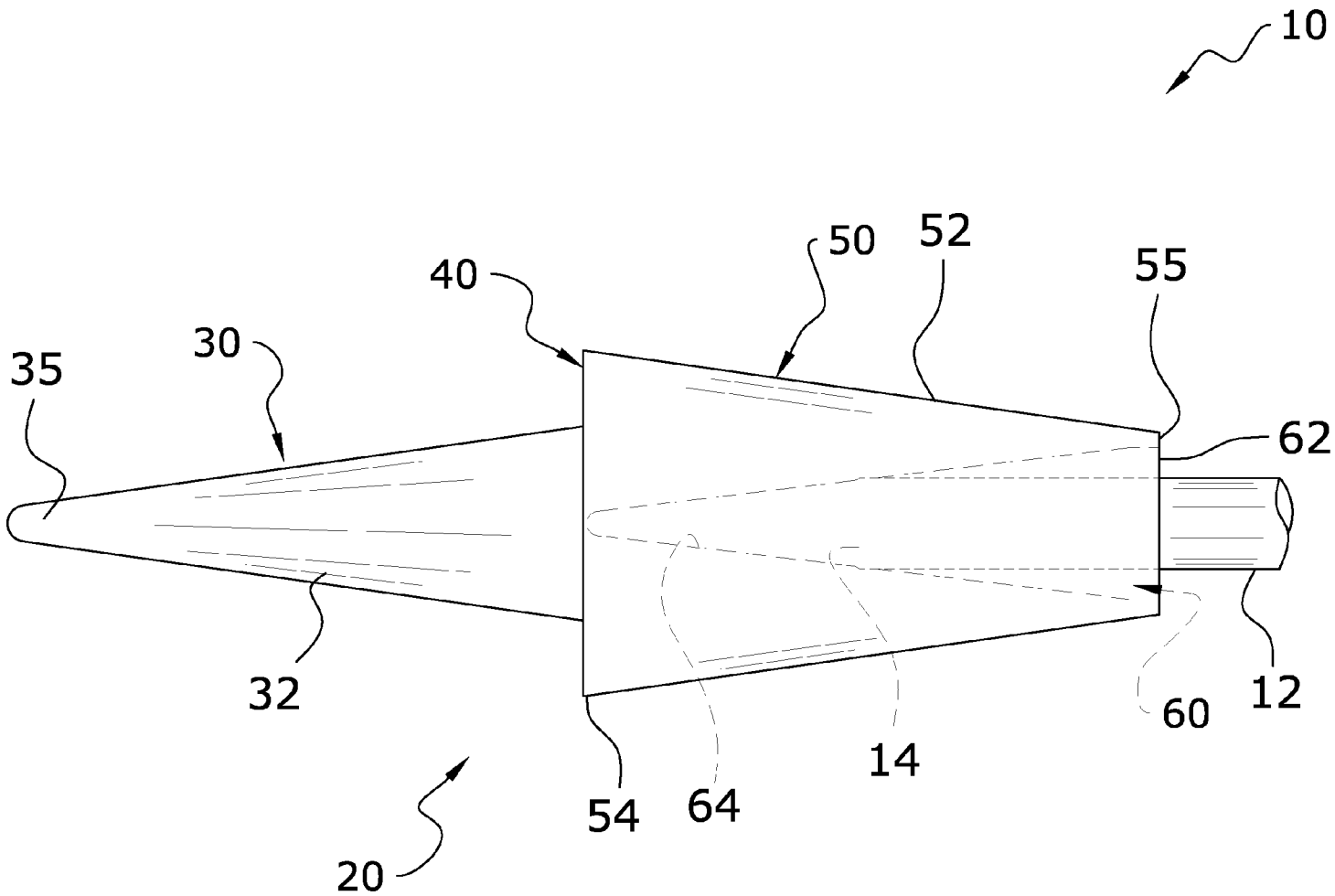
FIG. 7 is a side view of the present invention with the auxiliary structure inserted within the cavity.

The second elongated portion 50 is further preferably comprised of a substantially hollow structure as illustrated in FIGS. 1, 3 and 7. The first elongated portion 30 and the second elongated portion 50 are preferably comprised of an integrally formed structure; however it is appreciated that the first elongated portion 30 and the second elongated portion 50 may be comprised of separate structures fixedly or removably fastened together.

The second elongated portion 50 is further preferably concentric with the first elongated portion 30 as illustrated in FIGS. 1 through 7. The second elongated portion 50 is also directed in an opposing direction as the first elongated portion 30, wherein the user either inserts the first outer end 35 of the first elongated portion 30 within a hole 14 to seal the respective hole 14 with the first elongated portion 30 or inserts the second outer end 55 of the second elongated portion 50 within a hole 14 to seal the respective hole 14 with the second elongated portion 50. The first outer end 35 and the second outer end 55 are further positioned upon opposing ends of the plug 20 and the first inner end 34 and the first outer end 35 are adjacent to each other upon the plug 20.

The second elongated portion 50 includes the second inner end 54 and the second outer end 55 opposite the second inner end 54. A second inner diameter of the second inner end 54 is substantially greater than a second outer diameter of the second outer end 55, wherein the portion between the second inner end 54 and the second outer end 55 is preferably evenly tapered to connect the second inner diameter of the second inner end 54 to the second outer diameter of the second outer end 55 as illustrated in FIGS. 1 through 7.

The second inner diameter of the second inner end 54 is also larger than the first inner diameter of the first inner end 34. The first inner diameter of the first inner end 34 is also substantially similar to the second outer diameter of the second outer end 55, wherein the diameter of the plug 20 becomes increasingly larger from the first outer end 35 to the first inner end 34 and then from the second outer end 55 to the second inner end 54 as illustrated in FIGS. 1 through 7. In the preferred embodiment, the outer diameter of the first elongated portion 30 and the second elongated portion 50 approximately range from ⅛" to 1⅛"; however it is appreciated that the plug 20 may be comprised of various sizes to accommodate various size holes 14.

The second outer end 55 is further preferably comprised of a planar configuration to allow a sufficient size for an opening 62 extending within the second outer end 55. The second inner end 54 is comprised of a planar configuration to efficiently be positioned against and flush with the first inner end 34 of the first elongated portion 30 at the adjoining portion 40 of the plug 20 as illustrated in FIGS. 2 through 7.

The second outer surface 52 of the second elongated portion 50 is comprised of a tapered configuration and connects the second outer end 55 to the second inner end 54. A second angle defined by the second outer surface 52 and a horizontal axis or concentric longitudinal axis of the present invention is preferably comprised of an acute angle. In the preferred embodiment the second angle is comprised of an approximate 16 degree angle; however it is appreciated that the second angle may be comprised of various degree angles. The second angle of the second outer surface 52 is further preferably comprised of a substantially similar degree angle as the first angle of the first outer surface 32.

iii. Cavity

A cavity 60 extends within the second elongated portion 50 and extends toward the second inner end 54 and adjoining portion 40 as illustrated in FIGS. 1, 3 and 7. The cavity 60 extends from an opening 62 extending through the second outer end 55 of the second elongated portion 50, wherein the cavity 60 interconnects with the opening 62. The opening 62 is preferably comprised of circular shaped configuration to receive various size hoses; however it is appreciated that the opening 62 may be comprised of various shaped configurations.

The cavity 60 is comprised of an elongated configuration and preferably substantially extends an entire longitudinal length of the second elongated portion 50. In the preferred embodiment of the present invention the cavity 60 is comprised of a conical shaped configuration; however it is appreciated that the cavity 60 may be comprised of various types of elongated shapes all of which preferably vary in thickness (e.g. triangular, etc.).

The cavity 60 is further preferably concentric with the first elongated portion 30 and the second elongated portion 50 as illustrated in FIG. 3. The cavity 60 is also directed in an opposing direction as the second elongated portion 50 and a similar direction as the first elongated portion 30. An inner diameter of an inner surface 64 of the cavity 60 preferably evenly tapers toward the second inner end 54 as illustrated in FIGS. 3 and 7.

An angle defined by the inner surface 64 of the cavity 60 and a horizontal axis or concentric longitudinal axis of the present invention is preferably comprised of an acute angle. In the preferred embodiment the angle is comprised of an approximate 14 degree angle; however it is appreciated that the angle may be comprised of various degree angles. When inserting the auxiliary structure 12 (e.g. hose, etc.) within the cavity 60 the auxiliary structure 12 engages and slightly pushes outwardly on the inner surface 64 of the cavity 60 to secure the auxiliary structure 12 within the cavity 60 and form a tight seal around the auxiliary structure 12 and hole 14 within the auxiliary structure 12 as illustrated in FIG. 7.

D. Operation of Preferred Embodiment

In use, the hole 14 to be sealed and auxiliary structure 12 are first inspected for approximate size to allow the individual to determine if the hole 14 should be sealed with the first elongated portion 30, second elongated portion 50 or cavity 60 of the present invention. If the hole 14 is determined to be sealed with the first elongated portion 30 or the second elongated portion 50, the individual grasps the opposing portion (i.e. one not being utilized to seal the hole 14), wherein the opposing portion (i.e. first elongated portion 30, second elongated portion 50) is utilized as a handle.

Figure 4:
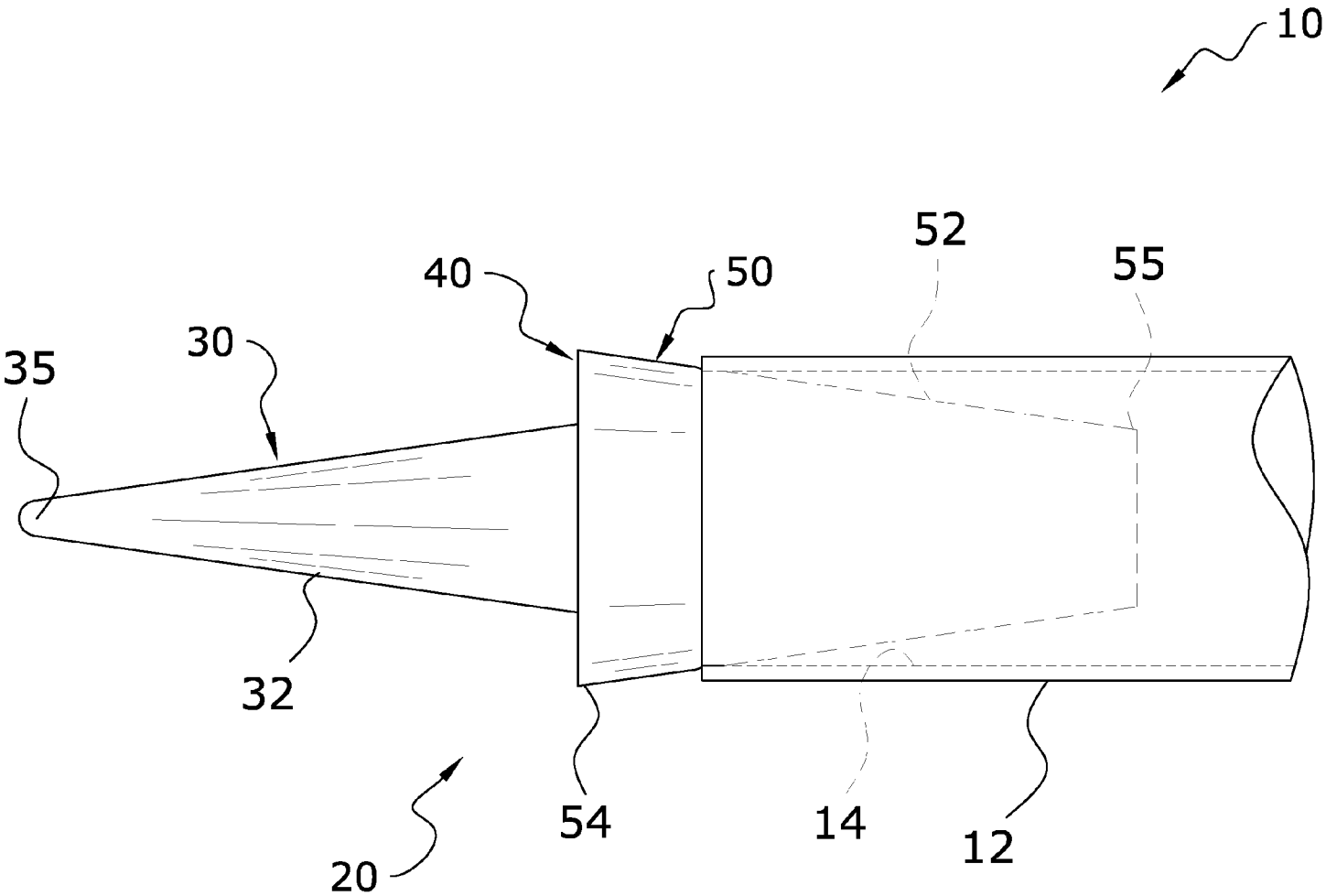
FIG. 4 is a side view of the present invention with the second elongated portion inserted within a hole, wherein the diameter of the hole is slightly smaller than the diameter of the second inner end of the second elongated portion.
Figure 5:
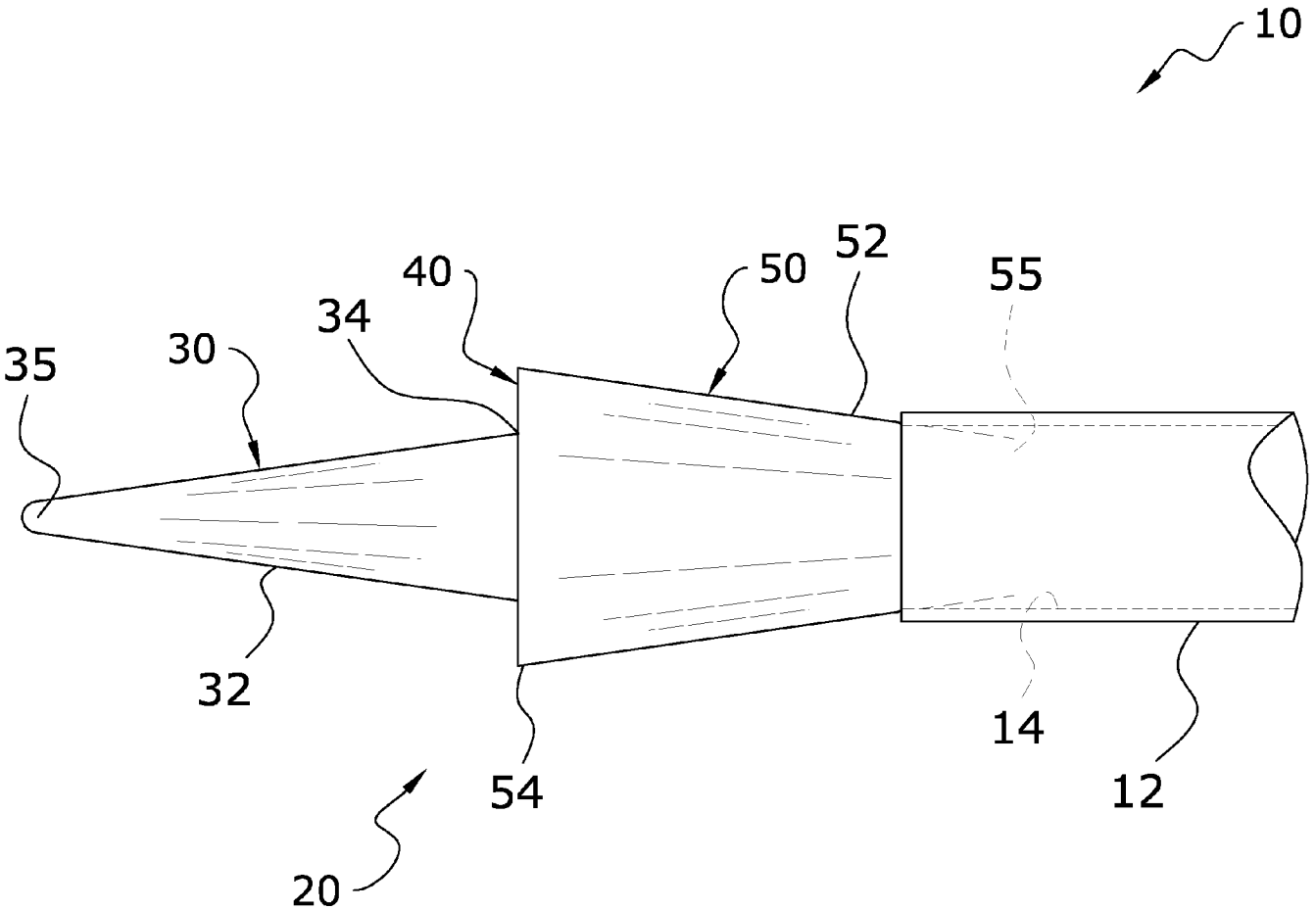
FIG. 5 is a side view of the present invention with the second elongated portion inserted within a hole, wherein the diameter of the hole is slightly larger than the diameter of the second outer end of the second elongated portion.
Figure 6:
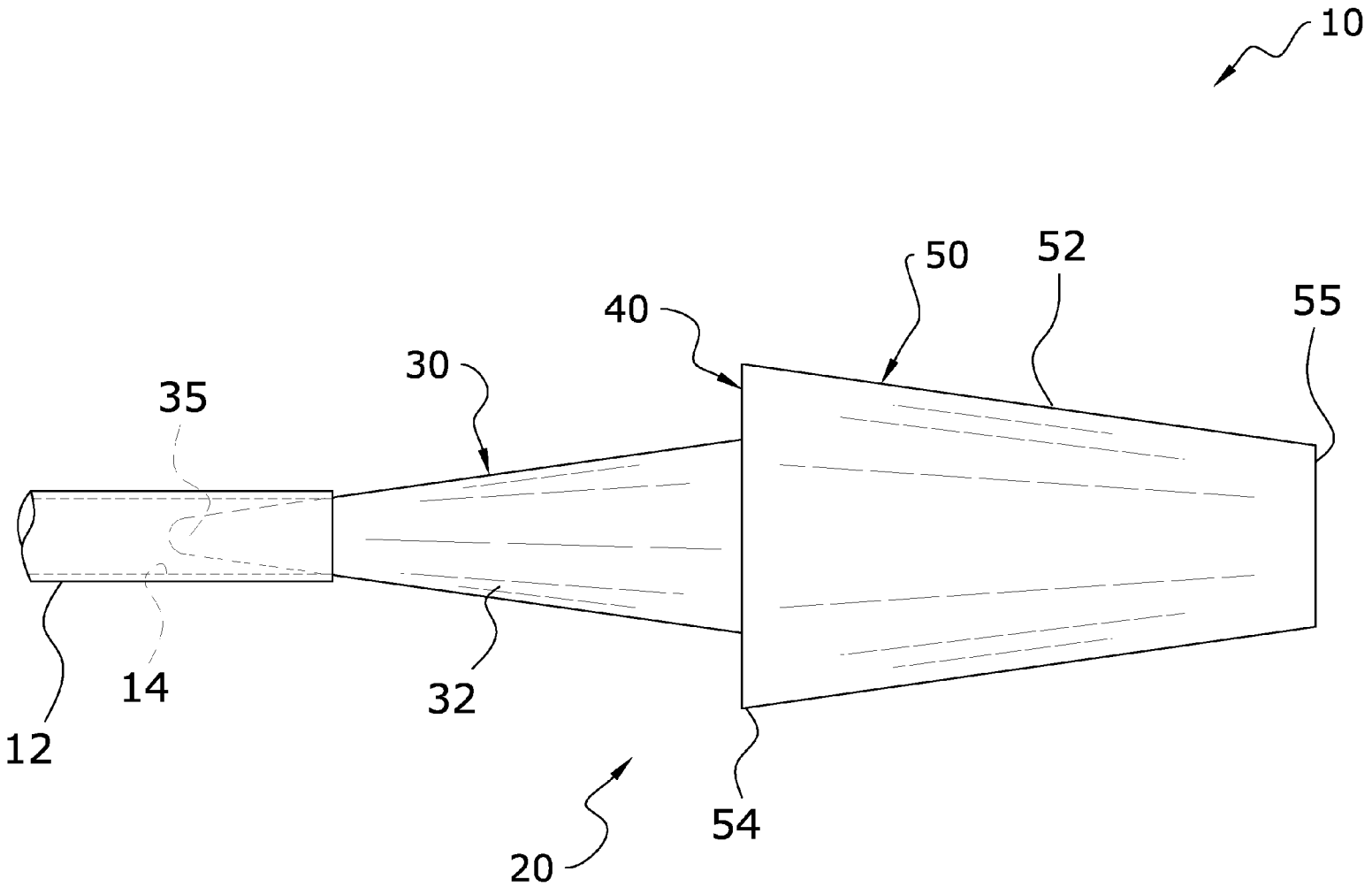
FIG. 6 is a side view of the present invention with the first elongated portion inserted within a hole.

The individual then directs the utilized portion (i.e. first elongated portion 30, second elongated portion 50) within the hole 14 until the utilized portion is securely positioned within the hole 14. The individual now twists and pushes upon (toward the hole 14) the opposing portion to further secure the utilized portion within the hole 14. The hole 14 should now be sealed as illustrated in FIGS. 4 through 6. If the user desires to remove the plug 20 from the hole 14, the previously described process is simply reversed.

If it is determined by the user to utilize the cavity 60 to seal the hole 14, the auxiliary structure 12 is directed within the opening 62 and then the cavity 60 of the second elongated portion 50. The individual continues to push the auxiliary structure 12 within the cavity 60 until the auxiliary structure 12 is secure within the cavity 60 as illustrated in FIG. 7. It is appreciated that the individual may need to twist and push the auxiliary structure 12 (in a similar manner as previously described) within the cavity 60 to achieve a more secure seal between the cavity 60 and the auxiliary structure 12.

It is also appreciated that if the present invention is utilized to seal a shallow hole 14, wherein the first elongated portion 30 or the second elongated portion 50 is too long, the individual may cut off a portion of the first elongated portion 30 or the second elongated portion 50 (i.e. whichever portion is desired to be utilized) to shorten the respective portion 30, 50. The first elongated portion 30 or the second elongated portion 50 may now be inserted within the hole 14 in a manner similar to as previously described.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A hole plug system having opposed engaging ends, comprising:

a resilient first elongated portion including a first inner end and a first outer end, wherein said first inner end is opposite said first outer end;

wherein said first elongated portion includes a first tapered outer surface and wherein said first tapered outer surface tapers inwardly toward said first outer end;

wherein said first tapered outer surface is straight;

wherein said first elongated portion is comprised of a conical shape throughout;

a resilient second elongated portion including a second inner end and a second outer end, wherein said second inner end is opposite said second outer end and wherein said second inner end extends from said first inner end;

wherein said second elongated portion includes a second tapered outer surface and wherein said second tapered outer surface tapers inwardly toward said second outer end;

wherein said second tapered outer surface is straight;

wherein said second elongated portion is comprised of a conical shape throughout; and a cavity extending within said second elongated portion towards said first elongated portion, wherein said cavity includes a tapered inner surface;

wherein said tapered inner surface is straight;

wherein said cavity is comprised of a conical shape throughout.

2. The hole plug system having opposed engaging ends of claim 1, wherein said second elongated portion and said cavity share a concentric axis.

3. The hole plug system having opposed engaging ends of claim 1, wherein a first inner diameter of said first inner end is greater than a first outer diameter of said first outer end.

4. The hole plug system having opposed engaging ends of claim 3, wherein a second inner diameter of said second inner end is greater than a second outer diameter of said second outer end.

5. The hole plug system having opposed engaging ends of claim 4, wherein said first inner diameter is smaller than said second inner diameter.

6. The hole plug system having opposed engaging ends of claim 1, wherein a first angle defined between said first tapered outer surface and a first longitudinal axis of said first elongated portion and a second angle defined between said second tapered outer surface and a second longitudinal axis of said second elongated portion are substantially similar.

7. The hole plug system having opposed engaging ends of claim 1, wherein said first elongated portion and said second elongated portion share a concentric axis.

8. The hole plug system having opposed engaging ends of claim 1, wherein said first elongated portion is directed in an opposing direction as said second elongated portion.

9. The hole plug system having opposed engaging ends of claim 1, wherein said first outer end is comprised of a substantially pointed configuration and wherein said second outer end is comprised of a substantially planar configuration.

10. A hole plug system having opposed engaging ends, comprising:

a first elongated portion including a first inner end and a first outer end, wherein said first inner end is opposite said first outer end;

wherein said first elongated portion includes a first tapered outer surface and wherein said first tapered outer surface tapers inwardly toward said first outer end; and a second elongated portion including a second inner end and a second outer end, wherein said second inner end is opposite said second outer end and wherein said second inner end extends from said first inner end;

wherein said second elongated portion includes a second tapered outer surface and wherein said second tapered outer surface tapers inwardly toward said second outer end;

wherein said second elongated portion includes an opening extending through said second outer end and wherein said second elongated portion includes a cavity extending within said second elongated portion from said opening;

wherein said cavity includes a tapered inner surface;

wherein said cavity is comprised of a conical configuration;

wherein said first elongated portion is comprised of a conical configuration and wherein said second elongated portion is comprised of a conical configuration;

wherein said cavity extends toward said first elongated portion;

wherein said second elongated portion and said cavity share a concentric axis;

wherein a first inner diameter of said first inner end is greater than a first outer diameter of said first outer end;

wherein a second inner diameter of said second inner end is greater than a second outer diameter of said second outer end;

wherein said first inner diameter is smaller than said second inner diameter;

wherein a first angle defined between said first tapered outer surface and a first longitudinal axis of said first elongated portion and a second angle defined between said second tapered outer surface and a second longitudinal axis of said second elongated portion are substantially similar;

wherein said first elongated portion and said second elongated portion share a concentric axis;

wherein said first elongated portion is directed in an opposing direction as said second elongated portion.

11. The hole plug system having opposed engaging ends of claim 10, wherein said first tapered outer surface is straight.

12. The hole plug system having opposed engaging ends of claim 10, wherein said second tapered outer surface is straight.

13. The hole plug system having opposed engaging ends of claim 10, wherein said tapered inner surface is straight.

14. The hole plug system having opposed engaging ends of claim 10, wherein said first tapered outer surface is straight, wherein said second tapered outer surface is straight, and wherein said tapered inner surface is straight.

* * * * *